US007247017B2

(12) United States Patent
Furner

(10) Patent No.: US 7,247,017 B2
(45) Date of Patent: Jul. 24, 2007

(54) MELTING PLATE CANDLES

(75) Inventor: Paul E. Furner, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 147 days.

(21) Appl. No.: 10/780,028

(22) Filed: Feb. 17, 2004

(65) Prior Publication Data

US 2004/0229180 A1 Nov. 18, 2004

Related U.S. Application Data

(63) Continuation-in-part of application No. 09/747,525, filed on Dec. 20, 2000, now Pat. No. 6,802,707, which is a continuation-in-part of application No. 09/468,970, filed on Dec. 21, 1999, now abandoned.

(51) Int. Cl.
*F23D 3/16* (2006.01)

(52) U.S. Cl. ..... 431/292; 431/35

(58) Field of Classification Search ..... 431/292, 431/291, 289, 288, 126, 35, 33
See application file for complete search history.

(56) References Cited

U.S. PATENT DOCUMENTS

| | | | |
|---|---|---|---|
| 213,184 | A | 3/1879 | Frick |
| 383,862 | A | 6/1888 | Clarke |
| 397,011 | A | 1/1889 | Leynen-Hougaerts |
| 405,786 | A | 6/1889 | Ludde |
| 407,051 | A | 7/1889 | Baumer |
| 408,973 | A | 8/1889 | Heller |
| 484,210 | A | 10/1892 | Ludde |
| 534,990 | A | 3/1895 | Baumer |
| 574,376 | A | 1/1897 | Baumer |
| 664,246 | A | 12/1900 | Ellis |
| 779,644 | A | 1/1905 | Ferrier |
| 803,848 | A | 11/1905 | Pereira |
| 837,240 | A | 11/1906 | Mulkerins |
| 874,241 | A | 12/1907 | Reischer |

(Continued)

FOREIGN PATENT DOCUMENTS

| | | |
|---|---|---|
| DE | 1767916 | 11/1970 |

(Continued)

OTHER PUBLICATIONS

International Candle House catalog (1966-67); Bobeshes pp. 54-55.

(Continued)

*Primary Examiner*—Josiah C. Cocks

(57) ABSTRACT

The present invention relates to melting plate candles which employ heat conductive elements to distribute heat from a burning flame at a wick to a support plate for a solid fuel and to the body of said solid fuel, so as to more rapidly liquify the solid fuel, such as paraffin wax, and to more uniformly and intensely heat such fuels to increase the efficiency of consumption thereof and to more rapidly release volatile materials contained within said fuels. The heat conductive support plate is configured so as to have a capillary lobe upon the surface thereof, which cooperatively engages a wick holder comprising a preferably consumable wick and heat conductive fins which conduct heat from a flame upon said wick to said support plate, said wick holder further engaging said solid fuel, and said support plate being configured so as to cause the flow of liquified fuel to the wick holder. The fuel may be provided in various forms, configured to cooperatively engage said wick holder and support plate, and may comprise various volatile materials. The capillary lobe, in conjunction with the wick holder, causes rapid and complete flow of the liquefied fuel to said wick.

39 Claims, 5 Drawing Sheets

U.S. PATENT DOCUMENTS

| | | | | |
|---|---|---|---|---|
| 1,044,256 | A | | 11/1912 | Satter |
| D43,845 | S | | 4/1913 | Hirschfeld |
| 1,174,934 | A | | 3/1916 | Hawkins et al. |
| 1,195,657 | A | | 8/1916 | Chersky |
| D49,902 | S | | 11/1916 | Labaree et al. |
| 1,226,850 | A | | 5/1917 | Booty |
| 1,229,140 | A | | 6/1917 | Ritter |
| 1,267,968 | A | | 5/1918 | Bulle |
| 1,299,977 | A | | 4/1919 | McGuire |
| 1,309,545 | A | | 7/1919 | Reicher |
| 1,316,624 | A | | 9/1919 | Lucas |
| 1,320,109 | A | | 10/1919 | Wooster |
| 1,336,635 | A | | 4/1920 | Knapp |
| 1,344,446 | A | | 6/1920 | Engman |
| 1,345,960 | A | | 7/1920 | Rosenberger |
| 1,484,964 | A | * | 2/1924 | Benneville ..... 431/126 |
| D67,108 | S | | 4/1925 | Steeple |
| 1,640,734 | A | | 8/1927 | Smith |
| 1,660,760 | A | | 2/1928 | Murphy |
| D75,463 | S | | 6/1928 | Bach |
| D80,971 | S | | 4/1930 | Sakier |
| D83,100 | S | | 1/1931 | Gisolfi |
| 1,867,420 | A | | 7/1932 | Root |
| 1,945,953 | A | | 2/1934 | O'Connell |
| 1,961,629 | A | | 6/1934 | Bolser |
| 2,001,312 | A | | 5/1935 | O'Connell |
| 2,079,170 | A | | 5/1937 | Horsley |
| D105,118 | S | | 6/1937 | Mackelfresh, Jr. |
| D110,902 | S | | 8/1938 | Loesch |
| 2,137,701 | A | | 11/1938 | Replogle |
| D119,587 | S | | 3/1940 | Fuerst |
| 2,234,903 | A | | 3/1941 | Muench |
| 2,237,523 | A | | 4/1941 | Damon |
| 2,240,071 | A | | 4/1941 | Gisolfi |
| 2,246,346 | A | | 6/1941 | Wells |
| 2,254,906 | A | | 9/1941 | Petrulis |
| 2,274,823 | A | | 3/1942 | Candy, Jr. |
| 2,291,067 | A | | 7/1942 | Atkins |
| 2,324,753 | A | | 7/1943 | Alexiade |
| 2,330,705 | A | | 9/1943 | Hamblet |
| 2,354,343 | A | | 7/1944 | Webber et al. |
| 2,393,767 | A | | 1/1946 | Gould |
| 2,462,440 | A | | 2/1949 | Tierney |
| 2,481,019 | A | | 9/1949 | Joyce |
| 2,494,995 | A | | 1/1950 | Gardner |
| 2,533,290 | A | | 12/1950 | Shaw |
| 2,713,256 | A | | 7/1955 | Oesterle et al. |
| 2,758,460 | A | | 8/1956 | Ciano |
| 2,775,006 | A | | 12/1956 | Kranc |
| 2,809,512 | A | | 10/1957 | Hartnett |
| RE24,423 | E | | 2/1958 | Oesterle et al. |
| 3,036,452 | A | | 5/1962 | Renwick |
| 3,045,855 | A | | 7/1962 | Lipman |
| 3,121,316 | A | | 2/1964 | Wilson |
| 3,183,688 | A | | 5/1965 | Sobelson |
| 3,236,072 | A | | 2/1966 | Goldszmid |
| 3,240,035 | A | | 3/1966 | Anderson |
| 3,285,694 | A | | 11/1966 | Marchi |
| 3,286,492 | A | | 11/1966 | Frazier |
| D206,946 | S | | 2/1967 | Knodt |
| D208,064 | S | | 7/1967 | Quistgaard et al. |
| D208,097 | S | | 7/1967 | Henn |
| 3,330,132 | A | | 7/1967 | Dick et al. |
| 3,462,235 | A | | 8/1969 | Summers |
| 3,466,135 | A | | 9/1969 | Summers |
| 3,516,774 | A | | 6/1970 | Livingstone |
| 3,565,281 | A | | 2/1971 | Collie |
| 3,583,853 | A | | 6/1971 | Schramm |
| 3,689,616 | A | * | 9/1972 | Bernard ..... 264/68 |
| 3,690,507 | A | | 9/1972 | Gaillus et al. |
| D226,240 | S | | 1/1973 | Twedt |
| 3,730,674 | A | * | 5/1973 | Gross ..... 431/288 |
| 3,741,711 | A | | 6/1973 | Bryant |
| 3,744,957 | A | | 7/1973 | Wright, Sr. |
| 3,749,904 | A | | 7/1973 | Graff |
| 3,762,857 | A | | 10/1973 | Andeweg |
| D229,852 | S | | 1/1974 | Lindblad |
| 3,797,990 | A | | 3/1974 | Rogers et al. |
| 3,831,899 | A | | 8/1974 | Doig |
| 3,873,263 | A | | 3/1975 | DeCroix |
| 3,884,383 | A | | 5/1975 | Burch et al. |
| 3,890,085 | A | | 6/1975 | Andeweg |
| D236,064 | S | | 7/1975 | Balbo |
| 3,898,039 | A | | 8/1975 | Lin |
| 3,905,507 | A | | 9/1975 | Lyu |
| 3,910,753 | A | | 10/1975 | Lee |
| 3,932,113 | A | | 1/1976 | Thrush |
| 3,994,502 | A | | 11/1976 | Lombardi |
| 4,013,397 | A | | 3/1977 | Neugart |
| 4,019,856 | A | | 4/1977 | Lacroix |
| D247,635 | S | | 3/1978 | Maxwell |
| D248,499 | S | | 7/1978 | Ulrich et al. |
| D248,500 | S | | 7/1978 | Ulrich et al. |
| 4,102,634 | A | | 7/1978 | Crisp |
| D248,787 | S | | 8/1978 | Ulrich et al. |
| D248,788 | S | | 8/1978 | Ulrich et al. |
| D248,789 | S | | 8/1978 | Ulrich et al. |
| 4,134,718 | A | | 1/1979 | Kayfetz et al. |
| D253,432 | S | | 11/1979 | Van Koert |
| D253,732 | S | | 12/1979 | Van Koert |
| 4,185,953 | A | | 1/1980 | Schirneker |
| 4,206,500 | A | | 6/1980 | Neil |
| 4,224,017 | A | | 9/1980 | Kayne |
| 4,234,303 | A | | 11/1980 | Neugart |
| D257,641 | S | | 12/1980 | Taylor |
| D264,385 | S | | 5/1982 | Meyer |
| 4,332,548 | A | | 6/1982 | Linton et al. |
| 4,381,914 | A | * | 5/1983 | Ferguson ..... 431/289 |
| 4,427,366 | A | | 1/1984 | Moore |
| 4,477,249 | A | | 10/1984 | Ruzek et al. |
| 4,494,926 | A | | 1/1985 | Riha |
| 4,524,408 | A | | 6/1985 | Minera |
| D280,443 | S | | 9/1985 | Boss |
| 4,544,351 | A | | 10/1985 | Marsicano |
| 4,551,794 | A | | 11/1985 | Sandell |
| 4,557,687 | A | | 12/1985 | Schirneker |
| 4,568,269 | A | | 2/1986 | Lin |
| 4,568,270 | A | | 2/1986 | Marcus et al. |
| 4,588,618 | A | | 5/1986 | Wolfe |
| D285,396 | S | | 9/1986 | Odate |
| 4,611,986 | A | | 9/1986 | Menter et al. |
| D292,525 | S | | 10/1987 | Van Deelen |
| 4,721,632 | A | | 1/1988 | Brown |
| 4,740,366 | A | | 4/1988 | Winston et al. |
| 4,755,135 | A | | 7/1988 | Kwok |
| 4,781,895 | A | | 11/1988 | Spector |
| 4,804,323 | A | | 2/1989 | Kim |
| 4,851,212 | A | | 7/1989 | Winston et al. |
| 4,878,832 | A | | 11/1989 | Lynch |
| 4,887,960 | A | | 12/1989 | Stewart et al. |
| 4,917,597 | A | | 4/1990 | Henze |
| D312,507 | S | | 11/1990 | Thoreson |
| 4,983,119 | A | | 1/1991 | Lin |
| 5,015,175 | A | | 5/1991 | Lee |
| D320,266 | S | | 9/1991 | Kunze |
| 5,060,858 | A | | 10/1991 | Santini |
| 5,069,617 | A | | 12/1991 | Lin |
| 5,078,591 | A | | 1/1992 | Depres |
| 5,086,380 | A | | 2/1992 | Hedner, Jr. |
| D325,077 | S | | 3/1992 | Kearnes |
| 5,101,328 | A | | 3/1992 | Hai |
| D329,942 | S | | 10/1992 | Carr |
| 5,174,645 | A | | 12/1992 | Chung |
| 5,193,995 | A | | 3/1993 | Keller |

5,338,187 A 8/1994 Elharar
5,363,590 A 11/1994 Lee
D355,266 S 2/1995 Caplette et al.
D356,472 S 3/1995 Jaworski
5,425,633 A 6/1995 Cole
D360,461 S 7/1995 Gillespie
D369,871 S 5/1996 Lui
D371,212 S 6/1996 Hardy et al.
D376,002 S 11/1996 Upson
D377,402 S 1/1997 Perkins
5,651,669 A 7/1997 Henry
D383,555 S 9/1997 Hardy
D383,944 S 9/1997 Lillelund et al.
5,690,484 A 11/1997 Leonard et al.
5,697,694 A 12/1997 Cutts
D390,676 S 2/1998 Hollington
D391,119 S 2/1998 Rapaz
D393,910 S 4/1998 Chambers et al.
D394,513 S 5/1998 Davis
D394,910 S 6/1998 Volker
5,797,739 A 8/1998 Lioi
5,807,096 A 9/1998 Shin et al.
D399,298 S 10/1998 Whitehead
5,840,246 A 11/1998 Hammons et al.
5,842,850 A 12/1998 Pappas
5,843,194 A 12/1998 Spaulding
5,871,553 A 2/1999 Spaulding
D410,756 S 6/1999 Kleinberg
5,911,955 A 6/1999 Fullam
5,921,767 A 7/1999 Song
5,927,959 A 7/1999 Johnson
5,951,278 A 9/1999 Young et al.
5,955,034 A 9/1999 Zaunbrecher et al.
5,955,958 A 9/1999 Lu
D415,295 S 10/1999 Kochis et al.
5,961,318 A 10/1999 Chambers et al.
5,961,967 A 10/1999 Powell et al.
D416,099 S 11/1999 Hardy
D416,341 S 11/1999 Allen
5,980,241 A 11/1999 Schirneker
6,019,804 A 2/2000 Requejo et al.
6,033,089 A 3/2000 Tesauro
6,033,209 A 3/2000 Shin et al.
6,033,210 A 3/2000 Freeman
6,036,042 A 3/2000 Pietruch et al.
D422,180 S 4/2000 Sundberg
6,050,812 A 4/2000 Chuang
D425,220 S 5/2000 Klett et al.
D425,636 S 5/2000 Freeman
6,059,564 A 5/2000 Morris
6,062,847 A 5/2000 Pappas
6,065,960 A 5/2000 Hardy
6,068,472 A 5/2000 Freeman et al.
D426,902 S 6/2000 Hardy et al.
6,074,199 A 6/2000 Song
6,079,975 A 6/2000 Conover
6,099,877 A 8/2000 Schuppan
6,106,279 A 8/2000 Hedlund
D430,943 S 9/2000 Zutler
D433,168 S 10/2000 Cousins
6,129,771 A 10/2000 Ficke et al.
6,144,801 A 11/2000 Lehoux et al.
6,152,728 A 11/2000 Griffel
D435,100 S 12/2000 Pesu et al.
D436,415 S 1/2001 Hardy
D436,416 S 1/2001 Iu
6,203,313 B1 3/2001 Holmes et al.
6,214,063 B1 4/2001 DeStefano et al.
D443,080 S 5/2001 Klett et al.
D443,081 S 5/2001 Klett et al.
D443,082 S 5/2001 Klett et al.
D443,101 S 5/2001 Williamson
6,231,336 B1 5/2001 Chen
6,241,362 B1 6/2001 Morrison
6,241,512 B1 6/2001 Freeman et al.
6,241,513 B1 6/2001 Jeneral
D445,030 S 7/2001 Croft et al.
D445,337 S 7/2001 Croft et al.
6,267,584 B1 7/2001 Zou
6,270,339 B1 8/2001 Zou
6,273,710 B1 8/2001 Zou
6,276,925 B1 8/2001 Varga
D447,418 S 9/2001 Bezek et al.
6,290,489 B1 9/2001 Seidler
D448,867 S 10/2001 Manocheo et al.
6,296,477 B1 10/2001 Lin
6,299,435 B1 10/2001 Freeman et al.
D450,395 S 11/2001 Bellenger
D450,865 S 11/2001 Bellenger et al.
6,361,311 B1 3/2002 Smith
D455,486 S 4/2002 Makino
D455,846 S 4/2002 Araujo
D456,536 S 4/2002 Araujo
D456,539 S 4/2002 Leeds
6,371,756 B1 4/2002 Toohey
6,375,455 B2 4/2002 Frandsen et al.
D459,498 S 6/2002 Araujo
6,398,544 B2 6/2002 Wright et al.
D461,916 S 8/2002 Araujo
D462,132 S 8/2002 Papai
6,428,311 B1 8/2002 Bernardo
6,435,694 B1 8/2002 Bell et al.
6,439,471 B2 8/2002 Ehrlich et al.
6,439,880 B1 8/2002 Ray
D462,793 S 9/2002 Freeman et al.
6,444,156 B1 9/2002 Schwarz et al.
6,450,802 B1 9/2002 Steck
6,454,561 B1 9/2002 Colthar et al.
D464,745 S 10/2002 Mangini et al.
6,468,071 B2 10/2002 Zoy
D465,587 S 11/2002 Papai
D466,236 S 11/2002 Papai
D466,633 S 12/2002 Bennetts et al.
6,488,494 B2 12/2002 Lee
6,491,516 B1 12/2002 Tal et al.
D469,550 S 1/2003 Moeller
D469,893 S 2/2003 Shen
6,520,770 B2 2/2003 Zou
D471,299 S 3/2003 Papai
6,531,063 B1 3/2003 Rose
6,537,063 B1 3/2003 Pecoskie
6,543,268 B2 4/2003 Wright et al.
6,544,302 B2 4/2003 Berger et al.
6,551,365 B2 4/2003 Berger et al.
6,554,448 B2 4/2003 Carpenter et al.
D474,854 S 5/2003 Lam
6,568,934 B1 5/2003 Butler
6,575,613 B2 6/2003 Brown et al.
6,579,089 B1 6/2003 Iu
6,585,510 B2 7/2003 Papai
6,592,637 B2 7/2003 McGee et al.
6,595,771 B2 7/2003 Chu
D478,180 S 8/2003 Boss
6,616,308 B2 9/2003 Jensen et al.
D481,143 S 10/2003 McMinn
D481,473 S 10/2003 Walsh
6,630,110 B2 10/2003 Urfig
6,648,631 B2 11/2003 Wright et al.
D485,624 S 1/2004 Kitamura
6,688,880 B1 2/2004 Pangle
6,695,611 B2 2/2004 Lee
D487,687 S 3/2004 Shields, Jr.
6,702,573 B2 3/2004 Massey
6,716,026 B1 4/2004 Beougher
6,730,137 B2 5/2004 Pesu et al.
6,733,279 B2 5/2004 Thigpen et al.

| | | | |
|---|---|---|---|
| D491,288 | S | 6/2004 | Young |
| D492,043 | S | 6/2004 | Mader |
| D493,548 | S | 7/2004 | Goldman |
| D495,437 | S | 8/2004 | Barbera |
| D495,438 | S | 8/2004 | Barbera et al. |
| 6,769,905 | B2 | 8/2004 | Gray et al. |
| 6,780,382 | B2 | 8/2004 | Furner et al. |
| D496,474 | S | 9/2004 | Murdick |
| 6,793,484 | B2 | 9/2004 | Pesu et al. |
| D497,680 | S | 10/2004 | McMinn |
| 6,799,965 | B1 | 10/2004 | Gaudioso |
| 6,802,707 | B2 | 10/2004 | Furner |
| 6,808,388 | B2 | 10/2004 | Lee |
| 6,849,240 | B2 | 2/2005 | Nakatsu et al. |
| 6,857,869 | B1 | 2/2005 | Sun |
| D508,291 | S | 8/2005 | Janssen |
| 6,923,639 | B2 | 8/2005 | Pesu et al. |
| 7,067,772 | B2 | 6/2006 | Tanner et al. |
| 7,086,752 | B1 | 8/2006 | Feuer |
| 2001/0012495 | A1 | 8/2001 | Furner et al. |
| 2001/0031438 | A1 | 10/2001 | Hannington et al. |
| 2002/0066789 | A1 | 6/2002 | Yen |
| 2002/0068009 | A1 | 6/2002 | Laudamiel-Pellet |
| 2002/0068010 | A1 | 6/2002 | Laudamiel-Pellet |
| 2002/0093834 | A1 | 7/2002 | Yu |
| 2002/0102187 | A1 | 8/2002 | Bellenger et al. |
| 2002/0119413 | A1 | 8/2002 | Cheng |
| 2002/0127507 | A1 | 9/2002 | Long |
| 2002/0166863 | A1* | 11/2002 | Wright et al. ..... 220/600 |
| 2003/0064336 | A1 | 4/2003 | Welch |
| 2003/0134246 | A1 | 7/2003 | Gray et al. |
| 2003/0162142 | A1 | 8/2003 | Bennetts et al. |
| 2003/0175148 | A1 | 9/2003 | Kvietok |
| 2004/0007787 | A1 | 1/2004 | Kvietok |
| 2004/0009103 | A1 | 1/2004 | Westring |
| 2004/0009447 | A1 | 1/2004 | Decker |
| 2004/0016818 | A1 | 1/2004 | Murdell |
| 2004/0028551 | A1 | 2/2004 | Kvietok |
| 2004/0029061 | A1 | 2/2004 | Dibnah et al. |
| 2004/0033171 | A1 | 2/2004 | Kvietok |
| 2004/0033463 | A1 | 2/2004 | Pesu et al. |
| 2004/0128879 | A1 | 7/2004 | Lu |
| 2004/0160764 | A1 | 8/2004 | Lee |
| 2004/0223871 | A1 | 11/2004 | Woo |
| 2004/0223943 | A1 | 11/2004 | Woo |
| 2004/0229180 | A1 | 11/2004 | Furner |
| 2004/0241053 | A1 | 12/2004 | Thompson |
| 2004/0265164 | A1 | 12/2004 | Woo |
| 2005/0019238 | A1 | 1/2005 | Hart et al. |
| 2005/0037306 | A1 | 2/2005 | Nakatsu |
| 2005/0037308 | A1 | 2/2005 | Decker |
| 2005/0079463 | A1 | 4/2005 | Yu |
| 2005/0164141 | A1 | 7/2005 | Paasch et al. |
| 2005/0214704 | A1 | 9/2005 | Pappas et al. |
| 2005/0227190 | A1 | 10/2005 | Pappas |
| 2005/0239010 | A1 | 10/2005 | Duska et al. |
| 2006/0084020 | A1 | 4/2006 | Nakatsu et al. |
| 2006/0084021 | A1 | 4/2006 | Kubicek |

FOREIGN PATENT DOCUMENTS

| | | |
|---|---|---|
| DE | 24 40 068 | 3/1976 |
| DE | 27 06 103 | 8/1978 |
| DE | 3335146 | 4/1985 |
| DE | 3403604 | 8/1985 |
| DE | 36 30 712 | 3/1988 |
| DE | 39 18 591 | 9/1990 |
| DE | 4203644 | 8/1993 |
| DE | 4241292 | 5/1994 |
| DE | 4314122 | 11/1994 |
| DE | 004 337 397 | 5/1995 |
| DE | 4425179 | 1/1996 |
| DE | 19508962 | 9/1996 |
| DE | 19548958 | 12/1996 |
| DE | 198 06 404 | 9/1998 |
| EP | 0146247 | 6/1985 |
| EP | 0 149 149 | 7/1985 |
| EP | 0 483 925 | 5/1992 |
| EP | 0846911 | 6/1998 |
| EP | 1054054 | 11/2000 |
| EP | 1564485 | 8/2005 |
| FR | 2628825 | 3/1988 |
| GB | 1514338 | 6/1978 |
| GB | 2 080 514 | 2/1983 |
| GB | 2 239 942 | 7/1991 |
| JP | 35-5167066 | 12/1980 |
| JP | 58-158427 | 9/1983 |
| JP | 62220594 | 9/1987 |
| JP | 06212189 | 8/1994 |
| JP | 06-330082 | 11/1994 |
| JP | 08-157864 | 6/1996 |
| JP | 08185710 | 7/1996 |
| JP | 9-063353 | 3/1997 |
| JP | 09-069312 | 3/1997 |
| JP | 09-302998 | 11/1997 |
| JP | 2003-213292 | 7/2003 |
| WO | WO 89/06141 | 7/1989 |
| WO | WO92/08776 | 5/1992 |
| WO | WO 95/12783 | 5/1995 |
| WO | WO95/16876 | 6/1995 |
| WO | WO 95/24588 | 9/1995 |
| WO | WO 96/02794 | 2/1996 |
| WO | WO96/21124 | 7/1996 |
| WO | WO 99/17055 | 4/1999 |
| WO | WO 99/45322 | 9/1999 |
| WO | WO 00/32989 | 6/2000 |
| WO | WO 01/46618 | 6/2001 |
| WO | WO 2004/008026 | 1/2004 |
| WO | WO2004/083349 A2 * | 9/2004 |
| WO | WO 2004/083718 | 9/2004 |
| WO | WO 2004/090417 | 10/2004 |

OTHER PUBLICATIONS

Pourette Catalog 1998; p. 12.

Prices London Candlemakers; http:www.prices-candles.co.uk/mainpage.htm; 1 page, printed Apr. 21, 2005.

Prices London Candlemakers; http:www.prices-candles.co.uk/catalogue/Accessories/Accessories%20Page%2008.jpg; 1 page; printed Apr. 21, 2005.

Two (2) photos of Price's "Coral Bay Fragranced Bathroom" product taken Jan. 1, 1999.

Stephanie Reiser Wrought Iron—"Welcome to CourtingCandle.com!" http://www/courtingcandle.com; 1 page printed on May 12, 2004.

Intl. Search Report dated Oct. 13, 2006, Appl. No. PCT/US 2006/020218.

Int. Search Report dated Jul. 27, 2006, Appl. No. PCT/US 2005/032266.

U.S. Appl. No. 09/742,631, Office Action dated Aug. 18, 2003.

U.S. Appl. No. 09/747,525, Office Action dated Sep. 9, 2003.

U.S. Appl. No. 09/747,525, Office Action dated May 20, 2003.

U.S. Appl. No. 09/747,525, Office Action dated Jan. 10, 2003.

U.S. Appl. No. 09/747,525, Office Action dated Jul. 2, 2002.

U.S. Appl. No. 09/747,525, Office Action dated Oct. 1, 2001.

U.S. Appl. No. 10/938,434, Office Action dated Jul. 17, 2006.

U.S. Appl. No. 10/978,744, Office Action dated Jul. 19, 2006.

U.S. Appl. No. 10/938,434, Final Office Action dated Nov. 20, 2006.

U.S. Appl. No. 10/978,744, Final Office Action dated Nov. 13, 2006.

U.S. Appl. No. 10/978,646, Office Action dated Aug. 3, 2006.

* cited by examiner

MELTING PLATE CANDLES

RELATED APPLICATION

This is a Continuation-In-Part application of Ser. No. 09/747,525, filed Dec. 20, 2000, now U.S. Pat. No. 6,802,707, which is in turn a Continuation-in-Part application of Ser. No. 09/468,970, filed Dec. 21, 1999, since abandoned.

FEDERALLY SPONSORED RESEARCH OR DEVELOPMENT

Not Applicable.

BACKGROUND OF THE INVENTION

The present invention relates to means to provide an improved fuel burning element, such as a candle or lamp, which consumes fuel more efficiently while presenting an improved means for distribution of volatile materials, while also providing an improved degree of safety while burning, and a candle holder which requires little or no cleaning to remove wax residue. The candles or lamps of the present invention comprise a solid fuel element located on a melting plate, a preferably consumable wick, and heat conductive means in the wick holder to transfer heat from the burning fuel, i.e. the flame, to the remaining fuel, thereby assuring its more rapid and complete melting, and both control and uniformity of the temperature of the melted pool of fuel. The melting plate incorporates a capillary lobe which cooperatively engages either or both of the wick holder and the fuel element in such a manner as to assure exact placement of both at the best position on the melting plate, while creating a capillary effect to feed melted fuel to the wick for efficient consumption. Such a configuration has been found to provide improved means to control the transfer of heat generated by a candle flame, and to provide an improved degree of safety for the burning of candles, such as votive candles. Specifically, the preferred embodiment of the present invention comprises the use of a capillary lobe at or near the center of the melting plate of a melting plate candle, said capillary lobe cooperatively engaging a complimentarily shaped wick holder having a heat conductive fin. By virtue of this combination of capillary lobe and cooperative wick holder, applicants have provided a candle in which the flame of the candle remains essentially at the same height, relative to the surface upon which the candle holder is placed.

Ordinary candles comprise a vertical, self-supporting body or column of wax, with a substantially horizontal top and a central longitudinal wick which extends through and above the wax. The exposed portion of the wick above the solid wax is lighted by a flame, and the heat generated by the flame melts a small volume of the wax at the top of the candle, adjacent the wick, establishing a puddle or reservoir of molten wax to serve as fuel for the flame on the wick, and to release any volatile actives present therein. The capillary attraction of the molten wax and the wick, which is generally a structure of closely related fibers, causes the molten wax to travel through the wick to the flame, by which it is consumed. As the wax is consumed in this manner, the body of wax diminishes and the top surface thereof progressively lowers. The upper portion of the wick, extending above the lowering wax, is generally consumed by the flame. The flame in such a candle remains in the same position relative to height, from the start to the end of the burn, at which time all of the wax has been consumed.

Also well known are such candles as votive candles and tea lights. For purpose of discussion, tea lights shall be considered to be relatively small candles in which a body of paraffin is located in a container, having a wick centrally disposed, while votive candles shall be considered to be candles of similar size provided without a container. At the lower end of the wick is typically found a wick clip having a flat horizontal bottom surface, which functions to retain the wick in its perpendicular position, even as the paraffin is melted and liquified by the heat of the flame. In most such votive candles and tea lights, the wick is a cotton material saturated with paraffin, and burns with the paraffin, thus being consumable. In such candles, or lights or warmers employing the same, the visible flame moves lower, or closer to the bottom surface of the container as the fuel and wick are consumed, down to the level of the bottom of the wick. Further, after consumption of all of the wax above this point in the unit, the container (of the tea light), the unburned wax, and the wick clip remain to be disposed of by the consumer. As a safety consideration in such candles, the wick is normally crimped or terminated at a point about 0.25 inches above the bottom of the wax, so as to cause the flame to extinguish above the bottom of the container, and to thus prevent the heat of the flame from reaching the surface upon which the candle is positioned, preventing damage to such surface, and reducing the likelihood of igniting possible contaminants such as burnt matchsticks remaining at the bottom of the candle, or carbonaceous remains of the consumable wick. Such an arrangement also has the detriment of leaving a small volume of unburned wax in the bottom of the container when the flame extinguishes.

Similarly, liquid fuel lamps are known in which a wick is supported with one end suspended in a reservoir of liquid fuel, such as lamp oil. By capillary action, the liquid fuel rises through the wick to the upper end thereof, where it is subjected to consumption by a flame. As fuel is consumed by the flame, additional fuel rises through the wick by capillary action to feed and maintain the flame. Permanent, or non-consumable, wicks are most frequently employed for this type of lamp.

In U.S. Pat. No. 4,557,687, Schirneker teaches a fuel element comprising a shell-like elongated housing in which a supply of fuel may be placed, with a non-consumable wick immersed in the fuel supply with its upper portion protruding from the top of the housing. When the fuel is a solid fuel, such as paraffin, the wick must conduct heat into the housing of the fuel in the area of the immersed wick to thereby melt the solid fuel so as to provide sufficient amounts of molten paraffin to be drawn up in the wick. Such conductivity may be obtained by means of a piece of metal embedded in the wick. The purpose of the fuel element is to provide a simulated log for a fireplace which does not require a chimney.

Neil, in U.S. Pat. No. 4,206,500, teaches a candle having a metal stiffener which fits within the wick. The stiffener is supported by a flat base portion large enough to render the wick free-standing by supporting the weight of the nonconsumable wick.

In U.S. Pat. No. 3,741,711, Bryant teaches a composite decorative candle formed of clear, undyed and unpigmented candle wax in any appropriate candle shape, provided with a centrally recessed glass cylinder into which a replaceable small candle may be placed. Thus, the decorative outer candle may have a refill unit, such as a votive candle or tea light, placed therein to provide indefinite reusability. If the outer candle body comprises surface ornamentation, a luminescent glow through the candle body results when the inner candle is burned, and the outer candle is not consumed.

U.S. Pat. No.3,910,753, of Lee, discloses a wax burner comprising a vessel having a heat conducting metal heat sink surrounding and supporting a wick which projects upwardly, and has a heat conductive metal core means conducting heat into the heat sink, which acts as a wax melting surface. The wax burner may be fueled by paraffin wax or other suitable solid fuel, which may be added to the melting surface as required. The burner may constitute one or more units. In Lee, however, the fuel is neither supported nor contained by the heat sink, which is configured much like a spool, with upper and lower flanges, or upper and lower flat horizontal surfaces. The upper flange or upper surface acts as a heating surface, while the lower flange serves as a base for the heat sink, engaging the bottom surface of the burner vessel. Slots in the vertical surface of the heat sink provide means for the wax, melted by the heat sink, to flow from the exterior surface thereof to the internally located wick. Since the wick structure of the patent includes a metal core and a heat conductive metal sleeve about the wick, the wick structure is an integral portion of the heat sink of the burner assembly, is non-consumable, and requires priming with wax prior to its first use. In use, solid wax is added to the heating surface, and replenished as necessary, or the entire vessel may be filled with wax. It is to be noted that the vessel itself is not used to conduct heat to the fuel, but only to contain it, and that a separate heat transfer system, i.e. the heat sink structure, which is independent of and distinct from the heat radiated by the flame itself, is utilized to achieve burning of the wax fuel. Even with this added heat transfer mechanism to assist in melting of the fuel, complete utilization of all of the fuel in the vessel is unachievable, even when the burner is permitted to burn to self-extinction, in view of the relative positioning of the lower flange and the wax conducting means of the heat sink (i.e. slots in the vertical surface thereof, above the lower flange).

In U.S. Pat. No. 2,713,256, Oesterle et al teach a votive candle having a wick extending downward in the bottom of the candle into a tapered central body projection, where said wick engages an adapter inserted into a cup provided to hold the votive. The adapter is provided with means to support the wick of the candle until the candle has completely burnt out, thereby leaving no wax or wick residue in the cup, enabling a new candle to be inserted into the cup without removal of the adapter. The adapter does not function to provide a more even or uniform burning of the candle, but merely to provide a proper positioning of the votive candle. When placed over the adapter, and the upwardly directed tube thereof, the flame on the wick comes into contact with a wicking material retained in the base of the tube, so as to ignite such wicking and assure that all of the melted wax is burned, thus leaving a clean cup containing no remains of the previous candle when a new candle is put in place.

European Patent Application EP 1 054 054 A1, published Nov. 22, 2000, teaches a candle having a wick holder assembly for candles to be used on a supporting surface, wherein the wick holder provides enhanced control over heat transfer form the flame to the supporting surface upon which the candle rests. In this patent, the object of the wick holder assembly is to dissipate heat from the flame away from the support surface, essentially the opposite of the goal of the present invention.

A number of additional patents teach the use of heat conductive elements to liquify solid fuel for consumption at a wick, or to dispense an element such as a fragrance or insect control material. These include U.S. Pat. No. 5,078,591 of Despres; U.S. Pat. No. 4,755,135 of Kwok; and U.S. Pat. No. 5,425,633 of Cole; as well as PCT Application WO 89/06141, assigned to Lamplight Farms, Inc. In addition, numerous patents teach various modifications of candles, but fail to teach the combination set forth in the present invention.

The present invention provides a candle or lamp device capable of rapidly and completely melting a solid fuel to form a large liquid pool, thereby improving distribution of any volatile materials present in the fuel, and ensuring efficient and complete utilization of all of the fuel provided, while providing increased safety and convenient refilling. Further, the concept of the present invention offers highly decorative as well as functional candles and lamps, which may utilize a variety of gel and solid fuels, with the significant advantages of permitting rapid and convenient replacement of one fuel element by another at the whim of the consumer, without the need to clean or scrape the container in which said candle is utilized to remove a body of unburned fuel after the fuel element has been consumed.

BRIEF SUMMARY OF THE INVENTION

As utilized herein, the term melting plate candle shall encompass the combination of a solid fuel element and a heat conductive container or holder for the fuel. The terms fuel container and fuel holder shall be meant to encompass a support plate or melting plate comprising means to contain and melt the fuel element, a wick and wick holder engaging said support plate, and heat conductive elements, such as fins, referred to hereinafter as either wick fins or heat fins, and/or the skirt or base of the wick holder, to transfer heat from a flame upon said wick to said melting plate. Thus, the support plate functions to hold the fuel element, to retain the wick holder, and to conduct heat to the solid fuel element to thereby melt said fuel element to provide a liquid fuel to feed to the flame via the wick. Moreover, the base portion, i.e. the skirt or base, of the wick holder engages a lobe on the surface of said support or melting plate in such a manner as to transport said liquid fuel to the wick by capillary action. Accordingly, the manufacturer may provide melting plate devices, wicks and wick holder assemblies, and solid fuel elements, together, or independently (separately), and the consumer may join the separate elements to form a melting plate candle or fuel burner, with the option to change wicks and fuel elements at will. In the preferred embodiment of the invention, the wick, wick holder, and fuel element shall be provided as a single replacement unit to be utilized with a separately provided melting plate.

A key element of the present invention constitutes the capillary lobe on the melting plate, which lobe provides a locating device for a complementarily shaped wick holder, creates a site for capillary feed of fuel to the wick, and provides a means for heat transfer from the flame to both the melting plate and the solid fuel. The wick holder, in addition to providing a mounting means for the wick, has a base which conforms to the capillary lobe in such a manner as to create a capillary feed by which melted wax flows to the wick as fuel. In addition to the base or skirt of the wick holder being a heat conductive element, the wick holder may also provide an additional heat conductive element such as a fin, which may be in close proximity to, or in contact with the flame, and thereby conduct heat back to the wick holder base, and thus the capillary lobe, and thereby to both the melting plate and the fuel. It is to be understood that this arrangement of elements provides for much greater control of the degree of heating of the pool of melted wax, and the pool temperature, by virtue of the ability to control the amount of heat conducted to the pool by either the skirt of the wick holder or by the fins thereof, This may be accomplished by selection of the number of fins, for example, or control of the conductivity thereof, such as by choice of position relative to the flame, or material of construction. This in turn is most important in candles which dispense a volatile material, such as a fragrance, where a rapid temperature rise to the most effective temperature for volatilization of the active material is desired. Such a rapid temperature rise clearly results in a more rapid melt of the fuel element, and a more rapid dispensing of volatile material. In fact, with the present invention, it is possible to tailor a melting plate candle to a specific volatile active to be contained within a fuel element, by permitting control of the amount of heat conducted to the pool of melted fuel, and thus controlling the temperature thereof.

Alternative aspects of the present invention provide for the fuel element to be provided as a separate element which is complementarily shaped relative to the wick holder, so as to fit around the wick holder in its position on the capillary lobe of the melting plate. While it is possible for a permanent wick and wick holder assembly to be provided as a part of the melting plate, in the preferred embodiment of the invention the wick holder and fuel element are provided to the consumer as a single unit, or as individual separate units to be combined with the melting plate. In this manner, wick holders of differing shape and configuration may be combined with fuel elements of appropriate configuration which differ in color or scent, for example.

DETAILED DESCRIPTION OF THE INVENTION

Figure 1:
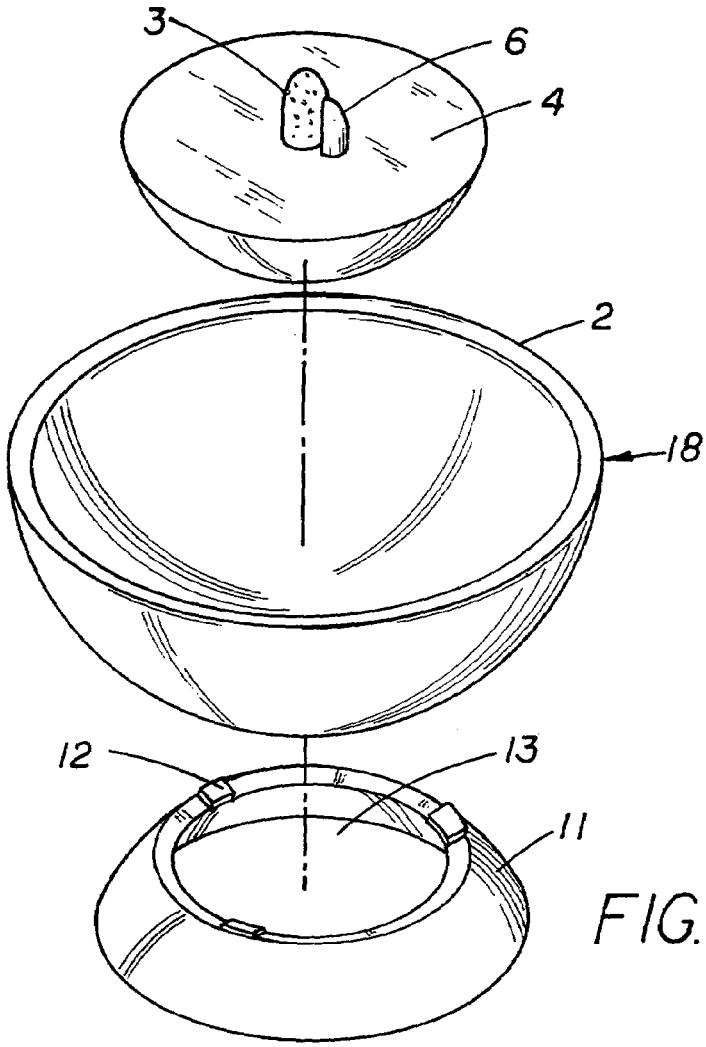
FIG. 1 illustrates the basic concept of a melting plate candle, in simplified perspective view, of which the present invention constitutes an improvement, and from which the present invention is derived.

The present invention provides a means for the burning of solid fuel elements, wherein said means ensure the maximum utilization of the solid fuel provided. The melting plate devices of the present invention comprise a container for solid or gel fuels, and a wick holder comprising a wick and optional heat transfer elements. These devices provide an improved transfer of heat from a heat source, i.e. a flame burning the fuel at the wick, to the remaining fuel and, more importantly, back to the container holding said fuel. Such devices are preferably both functional and designed so as to be decorative or esthetically pleasing.

The melting plate candle of the present invention comprises a fuel element, and a container encompassing the fuel, said container comprising a heat conductive support plate, or melting plate, in direct contact and in supporting or containing relationship, with the fuel element. The melting plate candle of the present invention may further comprise additional heat transfer elements, in either or both of the heat plate and the wick holder, to deliver heat by conductive means to the fuel and to the melting plate, in addition to that heat transfer obtained to the melting plate by direct radiation from the flame. Such conductive elements result in improved transfer of heat from the burning wick to both the fuel and the melting plate with which the fuel is in contact, thereby heating the fuel over a relatively larger surface. This, in turn, provides for more rapid melting of solid and gel fuels, and more rapid heating of the thus melted fuels, to provide a more uniformly heated pool of fuel, as well as greater control of temperature of the melted pool of fuel, allowing optimization of volatilization of actives present in the fuel. A result of the present invention is more rapid heating of the liquefied pool of fuel to temperatures which are not readily achieved by a conventional candle or lamp, so as to more rapidly and fully melt the solid fuel and to improve consumption of the fuel. The melting plate element thus functions as a heating plate for the fuel element and the melted fuel. As such, it is evident that the melting plate is preferably comprised of a heat conductive material, such as a metal, although less conductive materials, such as glass or ceramic may be employed with less efficiency due to less conductivity. The preferred material for use as the melting plate is polished aluminum, due to its high efficiency as a conductor of heat, its light weight, and for aesthetic reasons. It is also possible that the melting plate may constitute a non-conductive body having a conductive surface applied thereto, such as a less conductive surface having a thin layer of metal applied thereto. In this regard, it is noted that the surface of the melting plate may have a coating of a surface tension modifying material applied thereto for purposes of preparing a self cleaning or easy cleaning melting plate. For example, a thin layer of a polytetrafluoroethylene material may be applied over a rough surface to provide a smooth wetting surface upon which molten wax will flow easily, and which will enable easy removal of solidified wax upon extinguishing the flame and allowing the candle to cool.

The melting plate, which thus acts both as a fuel container and a heat transfer means to heat the fuel, is shaped so as to collect the melted or liquified fuel at its lowest point, at which point a wick is preferably located by means of a wick holder positioned upon a capillary lobe, so as to ensure that all fuel is fed to the wick, whereby the maximum consumption of the fuel is achieved. Thus, the melting plate is preferably shaped as a bowl, or in the form of a funnel, with the lowest portion thereof preferably, but not necessarily, centered. The entire interior surface of the fuel container is preferably highly heat conductive, and supports, contains, and heats the fuel, although containers in which only a small portion of the interior surface acts as a melting plate are within the scope of the present invention. Candles employing such melting plates shall be referred to, collectively, as melting plate candles. The melting plate itself may, of course, be essentially flat, with raised edges or a surrounding wall to contain the melted fuel.

Moreover, the melting plate helps to control the shape and depth of the pool of fuel which is burned at the wick, and to maintain the constancy thereof. It is to be understood that the fuel utilized in the present invention may be initially in solid or gel form, but must be in liquid form for moving up the wick by capillary action to the flame, where it is consumed. Thus, the fuel used with the melting plate candle shall be such that it will not be transported by wicking action at ambient or room temperature, but requires heating to a liquified state, i.e. melting, to be subject to capillary or wicking action. For convenience, the term solid fuel shall be used hereinafter to refer to fuel in either a gel or conventional solid state, such as conventional candle wax, preferably in the form of a hard, shaped body or "puck" of wax. It is also to be understood that the fuel consumed in the flame at the burning wick is drawn by the wick from a liquid pool of fuel, which pool is formed by melting the solid fuel, and heating said liquid pool by conductive heat transfer from the melting plate and heat exchange elements, in addition to the radiant heat from the flame on the wick. By the use of the melting plate technology of the present invention in addition to the conventional radiant heating of the surface of the fuel, the size, volume, depth, and temperature of the liquid pool of fuel are better regulated. And, as a result of greater control of heat transfer to the fuel, a melted, liquid pool thereof is more rapidly formed and heated to a desired temperature. Because the speed of achieving a uniformly heated liquid pool of fuel is increased, a more efficient consumption of the fuel results, and a more complete usage of available fuel due to the decrease of fuel left unburned on the surface of the melting plate, as well as a more efficient release of any volatile active materials in said fuel, such as fragrances. In preferred embodiments of the present invention, a pool of liquid, i.e. melted, fuel rests upon the surface of the heat conductive melting plate. This pool of fuel may initially contain unmelted fuel in the solid state, as well as melted fuel, and the elevated temperature of the pool achieved by the present invention aids in assuring a complete melting of the solid wax puck and complete and optimized dispersal of any volatile active materials present in the fuel. As a comparison to a conventional candle, it may be seen that in the conventional candle, the wax melts around the flame at the top of the wick, and as the wick is consumed, the flame moves downwardly. In the present invention, the wax melts around the flame, but the end of the wick is at a relatively constant height, and the flame does not move significantly downward. As a result, a more aesthetically pleasing candle is provided.

Generally, the melting plate device embodies both a melting plate and secondary heat conductive elements, which secondary elements may be part of the wick holder and in close proximity to the flame, to ensure more uniform and rapid distribution of heat from the flame upon the wick. The wick is affixed in its preferred position by means of the wick holder. The wick, which is preferably a consumable wick, may be any filamentary body which is sufficiently sturdy, which will burn with a steady flame, and which is capable of drawing up the molten candle fuel by capillary action. Such a wick may be of any conventional consumable wick material, such as cotton, cellulose, nylon, or paper, but may be non-consumable as well. The wick holder and wick may preferably be located in the center of the candle, or may be off-center as desired. The presence of two or more wicks, and associated wick holders and capillary lobes, is also within the scope of the present invention. In the present invention, the wick is positioned in a wick holder which engages the melting plate by means of an appropriately located capillary lobe on the melting plate, which serves to locate the wick holder (and thus, the wick), to transmit heat from the flame on the wick to both the fuel and the melting plate, and by means of the capillary nature of the appropriately sized gap formed by the fit of the lobe in relationship to the wick holder, to enhance flow of fuel to the wick. Moreover, the wick holder is preferably configured so as to engage the fuel element in a lock and key relationship and to position it on the melting plate in the preferred location.

The primary heat conductive element constitutes the melting plate itself, which may comprise portions formed, raised, or bent to be in closer proximity to the flame, such as a raised section of the plate, e.g. the upper edge of the raised side of the melting plate. For example, the melting plate may constitute a bowl shaped container having its outer periphery in close proximity to the flame, such as a container in which the side wall of the bowl is formed so that the lip of the upper opening curves back toward the center of the bowl, and thus toward the flame. The melting plate may also have secondary heat conductive elements, such as one or more raised portions which act not only to absorb and distribute heat by conduction, but to channel or direct the flow of liquid fuel to the wick. Such raised portions may constitute areas of material having higher heat conductivity than surrounding areas of the container. In such examples, the support plate may comprise a less conductive material, such as glass, and the primary heat exchange may be by radiant heat and conducted heat by means of the secondary heat conductive elements of the wick holder. It may thus be seen that the wick holder assembly, comprising a wick, and a fuel element, in conjunction with a base configured so as to complimentarily engage a capillary lobe, may be utilized in any candle container comprising a capillary lobe.

In the present invention, a capillary lobe both engages and positions the aforementioned wick, wick holder, and fuel element in such a manner as to provide the most advantageous positioning thereof, as well as to create a capillary flow of melted fuel from the melting plate to the wick positioned in the wick holder, which is placed in such close relationship to the capillary lobe as to create a very narrow gap between the lobe and the wick holder. By virtue of this narrow gap, which may be from approximately 0.01 to about 0.04 inches, preferably about 0.02 inches, liquefied fuel rises to the wick for consumption. It should be noted that it is within the scope of the invention that the capillary action may be the result of grooves cut in the lobe, or in the wick holder, and that the wick holder may be held away from the lobe by the presence of appropriately positioned and sized bumps located on either the lobe, the wick holder, or the melting plate. Moreover, the capillary forming combination of elements may constitute a concave depression in the melting plate, rather than a raised male lobe, and the wick holder in such case may be an appropriately shaped male member which fits closely within the depression so as to create a capillary gap between the members, by which fuel is fed to the wick. Still further, it is contemplated that the capillary lobe, either in a male configuration or in a female configuration, need not constitute a raised circular member, but may be of any shape, such as for example cylindrical, pyramid shaped, square, oval, triangular, or any other desired shape, in combination with a like-shaped and appropriately dimensioned wick holder. It is also to be noted that the capillary lobe need not transmit liquid fuel to the wick at all parts of the perimeter of the capillary lobe. For example, a circular capillary lobe in conjunction with a circular wick holder need only create a capillary gap for a limited portion of its circumference, such as for 90, 180, or 270 degrees. Thus, the wick holder need not be in a close enough proximity to the lobe throughout the total area of engagement therewith to provide a full capillary effect, but only in sufficient area to provide an adequate flow of fuel to the wick to maintain the flame upon said wick.

Additional secondary heat conductive elements may be separate assemblies which are utilized in conjunction with the melting plate and consumable wick and wick holder. The secondary heat conductive element may take the form of heat fins or heat conductive surfaces attached to the wick holder, and having either vertical or horizontal orientation or elements of both. In preferred embodiments, such heat conductive elements are heated by contact with the flame, or by heat radiation from the flame, and conduct such heat to both the melting plate and to the fuel so as to more efficiently heat the fuel. The secondary heat conductive elements of the wick holder, hereinafter exemplified as heating fins, although not limited to fins per se, and intended to encompass other heat conductive extensions of the wick holder which may serve this function, may be of any heat conductive material, and may be either formed as an extension of the wick holder or joined to said wick holder in such a manner as to conduct heat from the flame to that portion of the wick holder which is engaged by the capillary lobe and/or the melting plate. The wick holder thus comprises fins, a means to hold the wick, the wick, and a base configured so as to engage the capillary lobe of the melting plate, and to transfer heat from said fins to said melting plate. Suitable and exemplary, although clearly not the only possible heat fins are illustrated in U.S. patent application Ser. No. 09/747,525, filed Dec. 20, 2000, now U.S. Pat. No. 6,802,707, incorporated herein by reference.

It is to be understood that the wick holder and associated secondary heat conductive elements are meant to be so situated and shaped as to engage or interlock with a replaceable solid fuel element, such as by being of a specific shape or configuration that will engage or mate with a complementarily shaped fuel element. In a similar fashion, the melting plate and/or the fuel container may be formed in such a manner as to permit placement of fuel elements of specific configuration, such as wax pucks having a complementary configuration, for example, in a preferred position in proximity to the heat conductive elements themselves, or to the wick holder, in such a manner as to maximize heat transfer from the melting plate to said fuel elements. In the most preferred embodiment, secondary heat conductive elements are present both on the melting plate, and as an element of the wick holder. In said most preferred embodiment of the invention, there is a capillary lobe present on the melting plate, positioned in such a manner as to transfer heat to the fuel element, and configured so as to engage a wick holder holding a consumable wick and having one or more heat conductive fins, and a fuel element such as a wax puck. Further, the engagement of the wick holder with the capillary lobe is such as to provide a capillary effect between the two for feeding fuel to the wick. In this embodiment, the consumer may purchase a replacement fuel element comprising a wax puck and a wick holder and wick, configured so as to engage a matching capillary lobe on the melting plate in such a manner as to position the fuel element and the wick holder, and having a heat conductive element in the appropriate location to most efficiently melt the fuel element. Alternatively, the consumer may purchase an assembly comprising a wick holder and wick, with separately available appropriately shaped fuel elements.

The use of the melting plate technology of the present invention may also provide such advantages as elimination of tunneling, significant reduction of retention of wax at the conclusion of the burn, and elimination of walking or off-center wicks, while also giving a larger pool of liquid wax with a relatively small flame in a relatively short time period. In addition, the container may be of almost any shape desired, providing for great aesthetic possibilities. Since the fuel element, either alone or in combination with a wick and wick holder, may be provided as a separate unit, the consumer may be provided a great number of choices as to the color, content, and nature of the fuel, and the configuration of the fuel element may be varied to provide a large choice of shapes, such as seasonably decorative items. For example, shapes such as pumpkins may be provided for Halloween, wreaths for Christmas, and flowers for all seasons. In addition, the fuel element preferably is configured as to cooperatively engage both the melting plate and the wick holder, which wick holder in turn engages the capillary lobe on the melting plate, in such a manner as to provide the consumer the greatest degree of ease in placement of the fuel element in optimal position in the melting plate candle, with the least possibility of incorrect placement. Further, the melting plate or support plate may have decorative features, such as designs, embossed, etched, printed, or stamped thereon.

Accordingly, the present invention provides a melting plate candle, wherein said candle comprises a container for a fuel element comprising a fuel selected from the group consisting of paraffin, beeswax, montan wax, camauba wax, microcrystalline wax, polyvinyl acetate, fatty alcohols, fatty acids, fatty esters, and gels incorporating such fuels, in a form selected from the group consisting of pucks, donuts, chips, slivers, balls, pellets, shavings, particulates, cubes, discs, three dimensional shapes, and wafers, or in any other suitable shape. Said fuel element may optionally further comprise such volatile active materials as fragrances, air fresheners, deodorizers, odor eliminators, odor counter-actants, insecticides, insect repellants, herbals, medicinal substances, disinfectants, sanitizers, mood enhancers, aroma therapy compositions, and the like. Such solid fuel may be colored for decorative effect, if so desired, and may be shaped to fit any given configuration of melting plate and/or wick holder. For example, the bottom of a solid fuel element should be curved complementarily to the shape of the melting plate upon which it is to rest, and have melting temperatures above ambient, but below the flame temperature of a wick burning such fuel.

These and still other advantages of the present invention will be apparent from the description which follows. The following description is merely of the preferred embodiments, and the claims should be looked to in order to understand the full scope of the invention.

Figure 2:
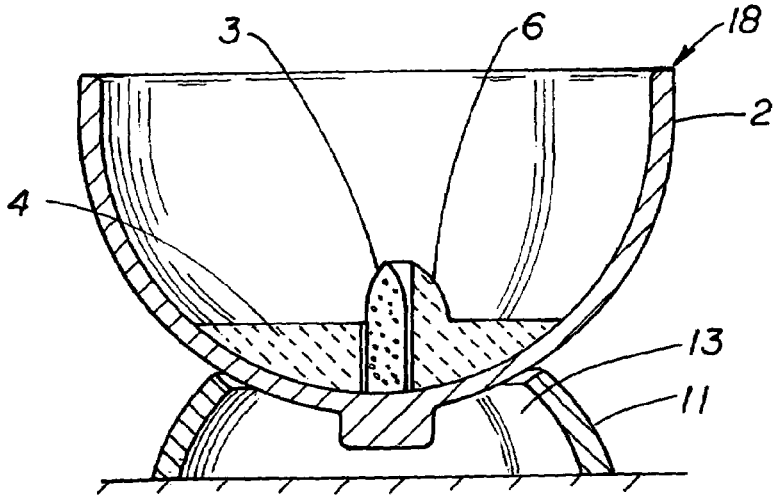
FIG. 2 illustrates a basic melting plate candle, in simplified cross section.

FIGS. 1 and 2 illustrate the broad concept of a melting plate candle in its most basic form, such as set forth in Ser. No. 09/747,525, filed Dec. 20, 2000, incorporated herein in its entirety by reference. The teachings of said pending patent application do not illustrate the capillary lobe and wick holder assembly of the present invention. As illustrated, a heat conductive melting plate container, 2, is provided, which transfers heat obtained from the heat source, a flame (not shown) located on wick 3, by means of heat conduction, to the solid fuel element, 4, which rests upon the surface of the melting plate. For purposes of illustration, and for clarity, but intending no limitation, the wick is illustrated as being of a relatively large diameter, rather than as a fibrous wick of small diameter. It is to be understood that the wick is positioned within and attached to the solid fuel element, 4, such as with a wick clip (not shown). The melting plate, 2, as shown in FIGS. 1 and 2, is heated directly by the flame on the wick, 3, by radiation, as a result of the melting plate being shaped so as to have a portion, shoulder 18, in proximity to the flame, the diameter of the melting plate bowl being such as to permit the inner surfaces thereof to absorb appreciable amounts of heat from the flame.

The melting plate of FIGS. 1 and 2 is shaped so as to have a raised outer shoulder, 18, thereby containing the resultant pool of melted fuel. It is to be understood that the melting plate may be in the form of a tray, bowl, concave plate, or other configuration which is capable of holding a pool of hot liquid fuel, and is preferably shaped so as to funnel or channel the liquified, i.e. melted, fuel to the wick. The melting plate may constitute a container in itself, as shown in FIGS. 1, 2, 5, and 6, or may be surrounded by a separate container. In the embodiment shown in FIGS. 1 and 2, the melting plate rests upon a nonconductive base, 11, or legs of non-conductive or insulating material, so as to permit placement upon a table, counter, or other surface. The non-conductive base, as illustrated, comprises contact points, 12, so as to minimize the amount of contact between the base and the melting plate, and to create an insulating air gap, 13, between the melting plate and the surface upon which the assembly rests.

The melting plate may be of any heat conductive material, such as brass, aluminum, steel, copper, stainless steel, silver, tin, bronze, zinc, iron, clad materials, heat conductive polymers, ceramics, glass, or any other suitable heat conductive material or combination of such materials. As shown in FIG. 2, the fuel is preferably located in direct contact with the surface of the melting plate, 2, which plate may, if desired, be constructed so as to have a non-conductive lower surface, so that the melting plate may rest upon a table surface or such. Such a configuration may result from a clad material, a conductive melting plate material coated on the external surface with a non-conductive material, a non-conductive material having an insert of a heat conductive material, or other suitable arrangements to permit the melting plate to be cool enough on the bottom surface to permit ease of handling, and/or placement upon surfaces not suitable for contact with heated bodies.

The wick, 3, preferably constitutes a conventional consumable wicking material, such as such as cotton, cellulose, nylon, or paper, or the like, which by capillary action will carry liquid fuel to the flame. Alternatively, nonconsumable wicks may comprise such materials as porous ceramics; porous metals; fiber glass; metal fiber; compressed sand, glass, metal, or ceramic microspheres; foamed or porous glass, either natural or man-made, such as pumice or perlite; gypsum; and chalk. However, for purposes of the present invention, the use of conventional consumable wicks is preferred. The wick, 3, may be located in the center of the melting plate, 2, or may be off-center as desired, provided that the melting plate is configured so as to channel or funnel melted fuel to said wick. The presence of two or more wicks is also within the scope of the present invention. The wick is provided in conjunction with the wick holder assembly, the preferred configuration of the wick holder being such as to cooperatively engage a complimentarily shaped capillary lobe, 8, on the melting plate, as shown in FIGS. 4 and 5, discussed hereinafter.

Figure 3:
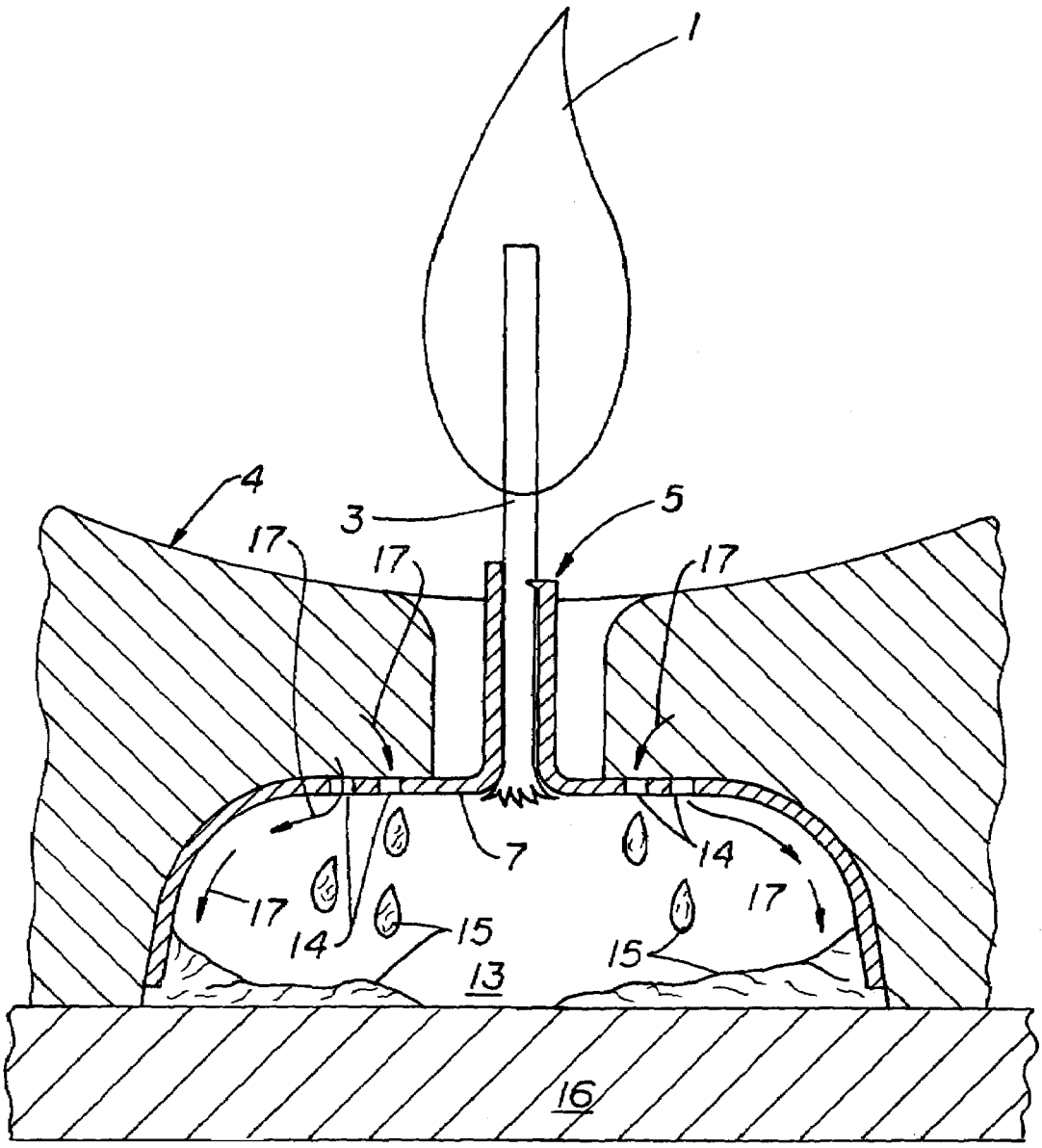
FIG. 3 illustrates the basic safety features of the key elements of the present invention, in a configuration which comprises the wick holder of the present invention placed directly upon a solid surface such as a table top, utilized without a capillary lobe located on a melting plate.

Illustrative of the wick holder assembly, and demonstrating key safety features of the present invention, FIG. 3 shows a configuration which comprises the wick holder, 7, of the present invention utilized without a capillary lobe located on a melting plate, but placed directly upon a solid surface, 16, such as a table top. This drawing demonstrates that if the wick holder assembly of the present invention were to be used in the absence of the melting plate and capillary lobe configuration of the present invention, and with a solid fuel element, 4, configured to fit the wick holder, 7, the candle would be self extinguishing. Here, the wick, 3, having a flame, 1, thereupon, is held in place by wick retention means, 5, in the wick holder, 7, which wick holder has weep holes, 14, therein. The wick holder, 7, is shown as having been placed directly upon a hard surface, 16, such as a wooden table top. As shown, the melted wax, 15, resulting from heat from the flame conductively and radiantly heating the wick holder, 7, passes through the weep holes, 14, in the direction of arrows 17, to land and accumulate on the surface 16. However, due to the fact that the wick, 3, terminates a considerable distance above the surface 16, the wick does not come into contact with the melted fuel, is thus not fed additional fuel, and extinguishes in a short period of time. For purposes of safety, it is preferred that the wick terminates at least 0.25, and preferably about 0.50 inches above the surface upon which the wick holder rests. The hard surface, 16, is for illustration purposes designated as being a wooden table top, but could as easily be a more flammable surface, such as a table cloth or sheet of paper.

Figure 4:
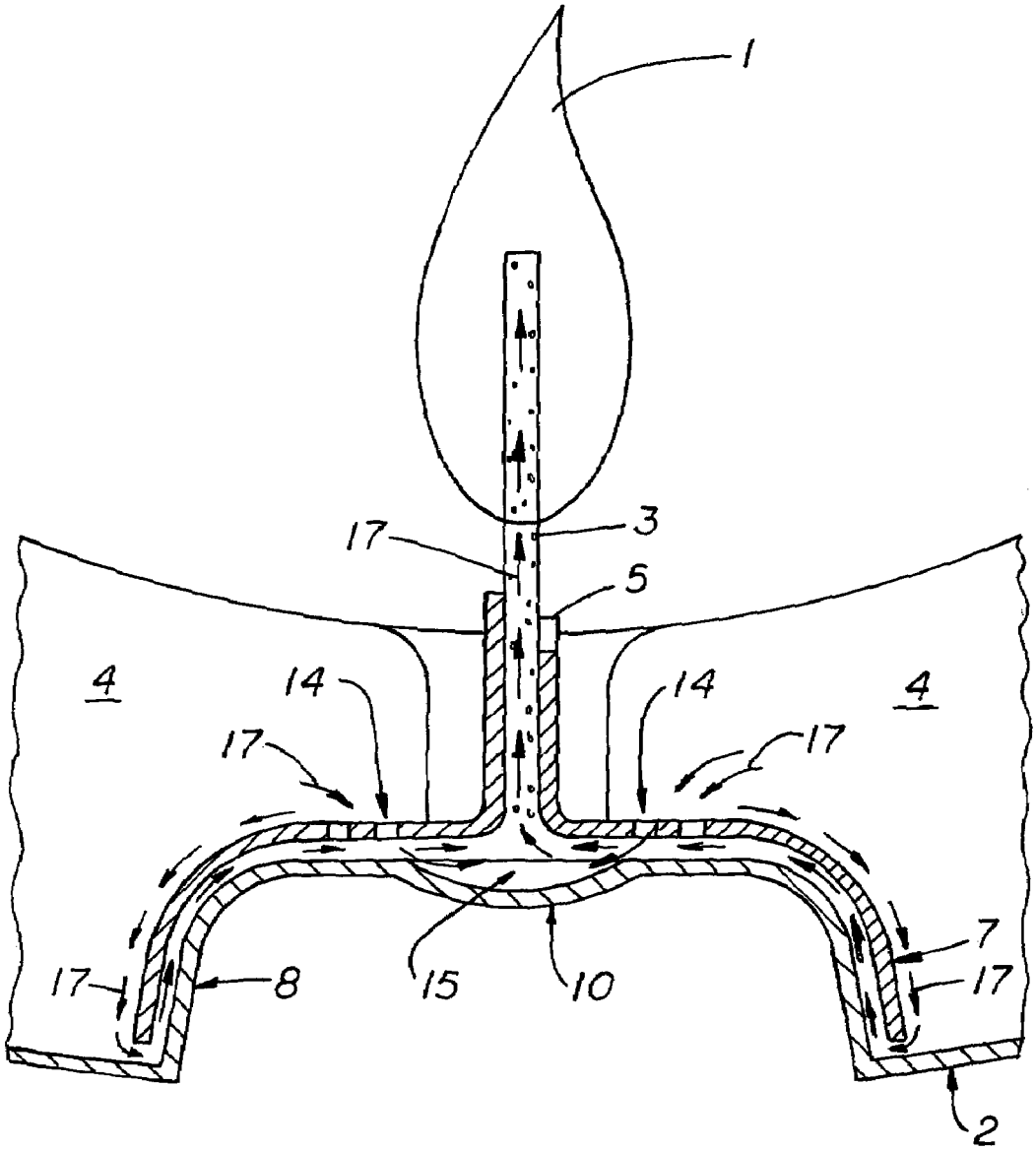
FIG. 4 is an illustrative version of the capillary lobe and wick holder assembly of the invention, showing a recess bowl in the capillary lobe, and the gap between said lobe and wick holder whereby a capillary effect is obtained.
Figure 5:
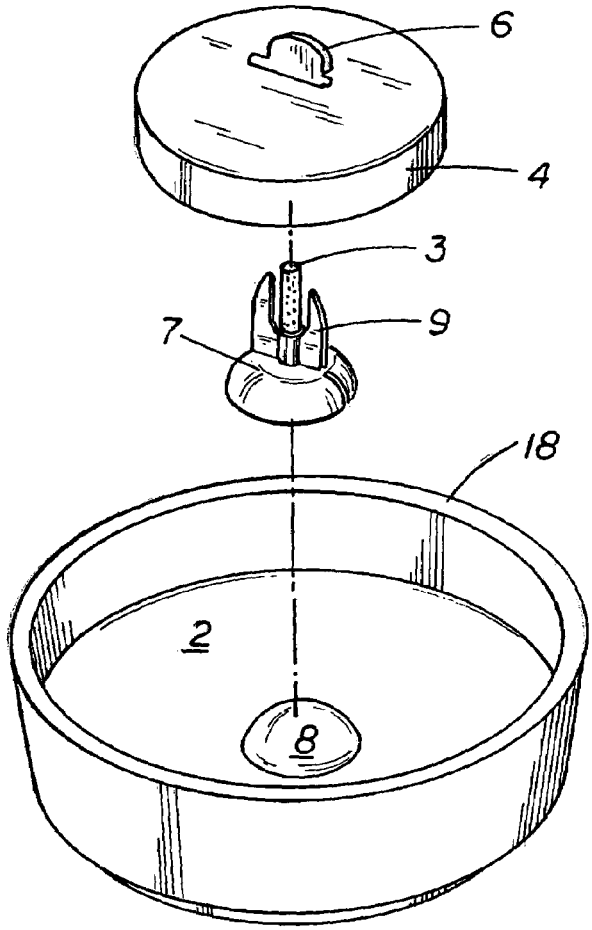
FIG. 5 is an exploded view of a melting plate with a wick holder with fins and incorporated wick, and a fitted fuel element incorporating a starting bump.

In a melting plate candle apparatus of the invention, as shown in FIG. 4, the wick, 3, is held in place by a heat conductive element, such as a wick holder, 7. To assure efficient heat exchange between the flame at the wick and the melting plate, the melting plate container, 2, has a portion, in this case a raised shoulder of the melting plate (not shown), which is in proximity to, and heated, such as by radiation, by the flame of the burning wick, which results in heat being transferred rapidly to the fuel by both conduction through the melting plate to the lower surfaces of the fuel, and by radiation from the flame to the upper surface of the fuel. The solid fuel element is thus subjected to melting both from heat from the flame and from the melting plate. As opposed to a conventional candle, transfer of heat from the flame to the fuel with a melting plate device is primarily by conduction, either through the melting plate or through additional heat conductive means, rather than by radiation, and is thus considerably more efficient, resulting in more rapid and more uniform melting of solid fuel and formation of a pool of liquid fuel, and a more efficient burn.

The preferred form of the concept, as illustrated in FIG. 4, comprises a capillary lobe, 8, which functions to position a wick holder, 7, comprising a wick, 3, and a wick retention feature 5, upon the melting plate. As illustrated, the wick holder is configured so as to fit closely over the capillary lobe, and has weep holes or perforations, 14, in the top surface thereof whereby liquefied solid fuel may readily flow in the direction of arrows 17, to both the base of the wick 3, and into a starter recess bowl, 10, formed in the top of the capillary lobe, 8. The fuel refill element, 4, is configured so as to fit above and around the wick holder, 7, permitting wick 3 to pass through the central open portion of said fuel element, where it is held in position by wick retention means, 5. In this position, the flame upon the wick heats, by radiant heat, both the fuel element 4, and the wick holder, 7, whereby the fuel element commences melting, and liquefied wax flows through the weep holes 14 to the starter recess bowl, 10, whereby it feeds to the wick for continued consumption. Simultaneously, melted wax flows down the sides of the wick holder, as indicated by arrows 17, to the melting plate, and to the capillary gap between the melting plate and the wick holder, whereby said melted wax is fed by capillary action to the recess bowl 10 and to the wick. Moreover, the heated melted fuel transfers heat to the surface of both the starter recess bowl and the wick holder, and thus to the melting plate.

In FIG. 5, an exploded perspective view of the invention is shown, with a bowl shaped melting plate container, 2, which comprises a capillary lobe, 8, located in approximately the center thereof. A wick holder, 7, is shown above the capillary lobe, the wick holder being shaped in such a manner as to fit closely over said capillary lobe. The wick holder, as illustrated, further comprises the wick, 3, and a heat fin, 9. A solid fuel element, 4, is shown, having a cut out portion through which the heat fin and wick assembly may pass, so as to place the wick in close proximity to a fuel starter bump, 6, on the top surface of said fuel element. The solid fuel element is shown as a wax puck, although other shapes may clearly be used within the scope of the present invention. Since difficulty in lighting the wick may be encountered, a starter bump of fuel, 6, may be provided in close proximity to the wick, 3. As illustrated in FIGS. 1, 2, 5, 6, and 8, this bump is most easily molded directly into the shape of the fuel element, and provides a ready source of liquid fuel to the wick when a match or other appropriate source of flame is employed to start the wick burning, which source of flame will melt the starting bump to thus create an initial pool of liquid fuel.

Figure 6:
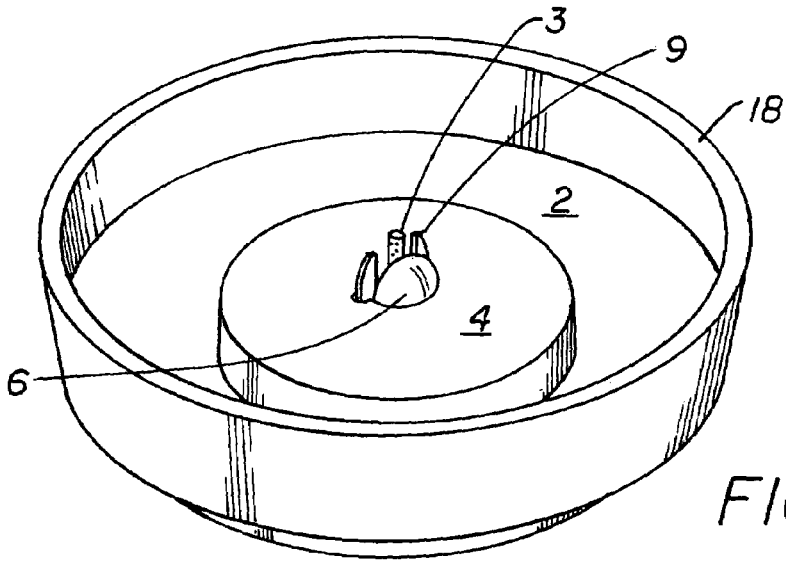
FIG. 6 is a perspective view of the assembled melting plate, wick holder, and fuel element of FIG. 5.

FIG. 6 shows the embodiment of FIG. 5 in operational configuration, showing the relationship of the elements in position for lighting of the wick, 3, wherein the melting plate, 2, is shown with a fuel element, 4, positioned on the capillary lobe (8, not visible) and centered around a wick holder assembly with the heat transfer fin, 9, and wick, 3, extending above the puck adjacent the starter bump, 6.

Figure 7:
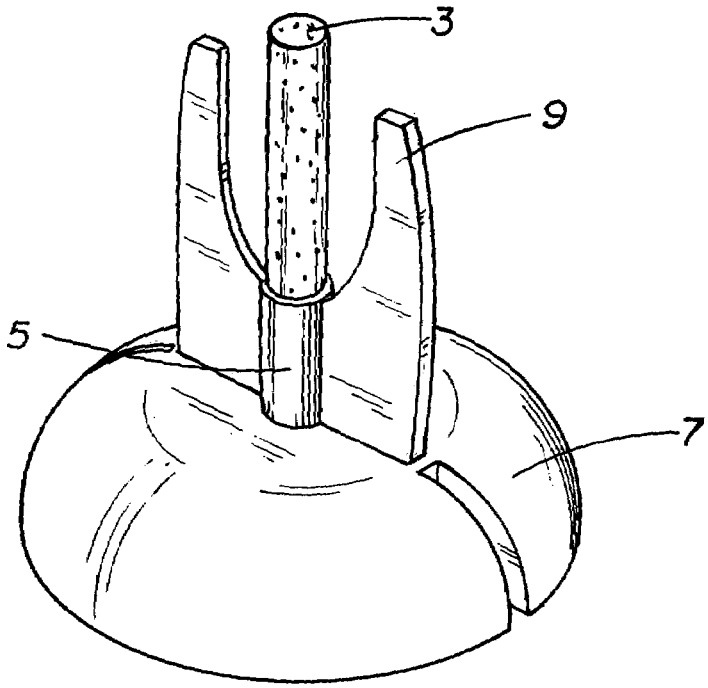
FIG. 7 is a perspective view of a wick holder assembly for use in the invention.

FIG. 7 is a close-up view of the wick holder assembly, 7, showing the heat fin, 9, and wick 3, held in position by wick retention means 5.

Figure 8:
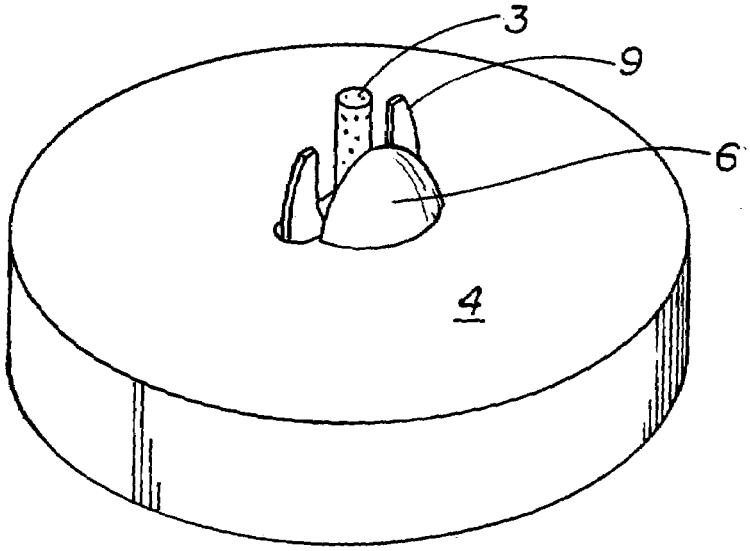
FIG. 8 is a perspective view of an assembled wick holder and fuel element with starter bump suitable for use in the present invention.

FIG. 8 shows the wick holder assembly of FIG. 7, in conjunction with a with a solid fuel element 4, illustrating the manner in which refill units for the melting plate candle are normally provided, showing the wax puck in cooperative relationship to wick 3, fins 9, and starter bump 6.

Thus, when using a solid fuel, such as wax, in conjunction with a heat conductive wick holder, solid fuel refill units may be shaped to fit the shape of the melting plate, with a "lock and key" relationship to the wick holder and hence to the melting plate. For example, the melting plate may be a decoratively shaped container, and wax may be provided in the form of refills specific for the container shape selected, such as round, square, oval, rectangular, triangular, or otherwise, so shaped that the wick holder assembly incorporated with the wax refill unit will fit and engage a complementarily shaped capillary lobe.

The use of a melting plate with additional heat conductive elements, such as the heat fins illustrated, offers a number of distinct advantages. First, it permits a larger pool of liquid fuel, due to improved heat conduction into the fuel, which results in more rapid formation of the pool. This in turn allows better regulation of the size and shape, as well as the temperature, volume, and depth of the liquified wax pool to allow more efficient use of fuels present. In fact, melting plates of the present invention permit ease of refill, with little or no cleaning. In most instances, no cleaning is required, but if desired, the plate may be conveniently washed in a manner such as a dish, plate of bowl is washed, in a wash basin or in a dishwasher. The use of a capillary lobe in the heat plate, in conjunction with heat fins on the wick holder, also reduces or eliminates retention of solidified excess fuel when the candle is allowed to burn itself out, and permits more complete and uniform burning of fuel elements which are other than round, i.e. square, oval, triangular, or in the shape of a flower or decorative object, etc. Further, the melting plate technology in conjunction with a capillary lobe and complimentary wick holder, results in devices which may be self extinguishing, and improvements in or elimination of typical burning problems encountered with candles, such as tunneling, drowning, collapsing, cratering, and wick drift. Candles utilizing the melting plate technology of the present invention are also more forgiving of formulation or process variances.

A number of small votive candles were prepared to test the efficiency of the invention relative to heat distribution and melting of the wax fuel. In the following Examples, all candles were comprised of 12 grams of the same wax (having a melting point of 130° F.), and were of the same dimension, with identical consumable wicks. Comparative examples comprised votive candles having a finned wick holder located upon a heat plate, and votive candles with a finned wick holder located upon a heat plate incorporating a capillary lobe as set forth in the present invention. Temperatures of the wax pool were measured at distances of 10 and 20 mm from the wick, using identical infrared temperature measuring methods in all examples.

In this experiment, votive candles with a finned holder absent a capillary lobe burned out after 125 minutes, and the votive candle with a finned holder and capillary lobe of the present invention burned out at about 115 minutes. It may be seen from the table, however, that the candle employing the combination of the wick holder and capillary lobe, as set forth in the present invention, achieved a higher temperature at a significantly earlier time than the candle employing a wick clip but no capillary lobe, at distances of both 10 mm and 20 mm from the wick. That is, the capillary lobe embodiment achieved higher wax pool temperatures at any given time and distance than the embodiment without the capillary lobe, demonstrating the very rapid heating effect of the present invention resulting from heat distribution through the melting plate. The pool temperatures, at both 10 mm and 20 mm from the wick, were higher than any previously observed for this type of wax after 10 minutes of burn time. It is to be noted that the rate of heating achieved and the rapidity of liquefaction, which result in a rapid melt of the entire fuel supply, and an increased surface area of melted fuel, in a much shorter time frame, assure a more rapid release of any volatile active materials present in the fuel. The higher temperatures achieved are also to be noted, for the same reasons. It is also evident that these factors may be effected by the size and shape of the capillary lobe employed, and that the lobe permits more rapid transfer of heat from the wick clip to the melting plate as a result of a greater surface area and the presence of vertically oriented surfaces, as well as by choice of material of the melting plate, the capillary lobe, and the heat fins.

TABLE

| Time versus Temperature at Distance from Wick | | | | |
|---|---|---|---|---|
| | 10 mm from Wick | | 20 mm from Wick Finned | |
| Minutes | Finned Clip, Heat Plate | This Invention | Clip, Heat Plate | This Invention |
| 10 | 115 | 176 | 79 | 146 |
| 15 | 121 | 167 | 83 | 139 |
| 20 | 128 | 182 | 87 | 166 |
| 25 | 136 | 193 | 89 | 182 |
| 30 | 144 | 200 | 91 | 190 |
| 40 | 128 | 205 | 93 | 191 |
| 50 | 146 | 209 | 130 | 190 |
| 60 | 177 | 210 | 165 | 188 |
| 70 | 203 | 210 | 172 | 186 |
| 80 | 208 | 210 | 174 | 177 |
| 90 | 200 | 210 | 167 | 176 |

While the present invention has been described with respect to what are at present considered to be the preferred embodiments, it is to be understood that the invention is not to be limited to the disclosed embodiments. To the contrary, the invention is intended to cover various modifications and equivalent arrangements within the spirit and scope of the appended claims. The scope of the following claims is to be accorded the broadest interpretation so as to encompass all such modifications and equivalent formulations and functions.

INDUSTRIAL APPLICABILITY

The melting plate and heat conductive element candles of the present invention, utilizing a capillary lobe and correspondingly shaped wick holder, can be used in connection with a large variety of solid fuels. The conductive materials of which the melting plate and heat fins may be constructed are commonly available, and the various configurations are readily produced. There is considerable interest for candles having extended burn times, and for refillable candles or solid fuel lamps.

I claim:

1. A candle comprising a meltable solid fuel element, a melting plate upon which said fuel element rests, and a capillary lobe located on said melting plate, the capillary lobe comprising a wall extending upwardly from the melting plate, wherein the capillary lobe cooperatively engages a base portion of a wick holder, the base portion comprising a down-turned skirt extending adjacent the wall of the capillary lobe, wherein a gap is defined between the skirt and the wall of the capillary lobe, and wherein capillary flow of melted fuel occurs upwardly through the gap along the wall of the capillary lobe from the melting plate to a wick retained over the capillary lobe by the wick holder.

2. The candle of claim 1, wherein said fuel element further comprises one or more volatile active materials.

3. The candle of claim 2, wherein said wick holder further comprises at least one heat conductive heat fin.

4. The candle of claim 3, wherein said meltable solid fuel element comprises a replaceable fuel element cooperatively engaging said melting plate, capillary lobe, and wick holder.

5. The candle of claim 4, wherein the replaceable fuel element further comprises a starter bump on the top surface thereof, in close proximity to said wick, for ease of lighting said wick.

6. The candle of claim 3, wherein said melting plate further comprises a raised heat conductive portion by which heat is conducted from a flame upon said wick to said melting plate and to said solid fuel element, whereby a pool of heated liquid fuel is created, said melting plate being configured to cause the flow of said heated liquid fuel toward said wick holder.

7. The candle of claim 1, wherein said wick holder is configured so as to cause said candle to rapidly burn out if said wick holder is not cooperatively engaged with said capillary lobe.

8. The candle of claim 1, wherein said melting plate is treated so as to be self cleaning.

9. The candle of claim 1, wherein the gap is for establishing the capillary flow of melted fuel upwardly toward the wick.

10. The candle of claim 1, wherein the melting plate comprises at least one of a heat conductive material or a non-heat conductive material.

11. The candle of claim 10, wherein the heat conductive material comprises at least one of brass, aluminum, steel, copper, stainless steel, silver, tin, bronze, zinc, iron, clad materials, heat conductive polymers, ceramics, or glass.

12. The candle of claim 11, wherein the heat conductive material is aluminum.

13. The candle of claim 1, wherein the wick terminates at least about 0.25 inches above the melting plate.

14. The candle of claim 1, wherein the capillary lobe is circular.

15. The candle of claim 1, wherein the gap is sized so as to enhance the flow of fuel to the wick.

16. The candle of claim 15, wherein the gap is from about 0.01 inches to about 0.04 inches.

17. The candle of claim 16, wherein the gap is about 0.02 inches.

18. The candle of claim 1 further comprising a coating of surface tension modifying material applied to the melting plate.

19. The candle of claim 18, wherein the coating comprises polytetrafluoroethylene.

20. The candle of claim 1, wherein the melting plate rests upon a non-conductive base.

21. The candle of claim 20, wherein the non-conductive base creates an insulating air gap between the melting plate and a surface upon which the candle rests.

22. The candle of claim 1, wherein the wick comprises at least one of a consumable wicking material or a non-consumable wicking material.

23. The candle of claim 22, wherein the consumable wicking material comprises at least one of cotton, cellulose, nylon, or paper.

24. The candle of claim 22, wherein the non-consumable wicking material comprises at least one of a porous ceramic, a porous metal, fiber glass, metal fiber, compressed sand, glass, a metal, ceramic microspheres, foamed glass, porous glass, pumice, perlite, gypsum, or chalk.

25. The candle of claim 1, wherein the wick holder comprises a hole in a top surface thereof and wick retention means.

26. The candle of claim 1, wherein the capillary lobe is located approximately in the center of the melting plate.

27. The candle of claim 1, wherein the melting plate comprises a decoratively shaped container.

28. The candle of claim 1, wherein the fuel element is a shape that comprises a round shape, a square shape, an oval shape, a rectangular shape, a triangular shape, a flower shape, or a decorative shape.

29. The candle of claim 1, wherein the fuel element and capillary lobe are complementarily shaped.

30. The candle of claim 1, wherein the wick holder is circular.

31. The candle of claim 30, wherein the capillary lobe in conjunction with the wick holder creates a capillary gap for a limited portion of a circumference of the wick holder.

32. The candle of claim 31, wherein the gap comprises 90°, 180°, or 270° of the circumference of the wick holder.

33. The candle of claim 1, wherein the fuel element comprises a fuel comprising at least one of paraffin, beeswax, montan wax, camauba wax, microcrystalline wax, polyvinyl acetate, fatty alcohols, fatty acids, fatty esters, or a gel.

34. The candle of claim 33, wherein the fuel element has a melting temperature above ambient.

35. The candle of claim 34, wherein the fuel element melts at a temperature between ambient temperature and a flame temperature of a wick burning the fuel.

36. The candle of claim 35, wherein the fuel element has a melting temperature of 130° F.

37. The candle of claim 2, wherein the one or more volatile materials comprise at least one of a fragrance, an air freshener, a deodorizer, an odor eliminator, an odor counteractant, an insecticide, an insect repellant, an herbal, a medicinal substance, a disinfectant, a sanitizer, a mood enhancer, or an aroma therapy composition.

38. The candle of claim 3, wherein the at least one heat conductive heat fin is configured so as to come in close proximity to a flame on the wick so as to conduct heat from the flame to said melting plate.

39. The candle of claim 6, wherein the temperature of the pool of heated liquid fuel exceeds a temperature of about 170° F. at a point about 10 mm from the wick, and about 140° F. at a point about 20 mm from the wick, within less than about 10 minutes of lighting the wick.

* * * * *